US008336737B2

(12) United States Patent
van der Heijden

(10) Patent No.: US 8,336,737 B2
(45) Date of Patent: Dec. 25, 2012

(54) FOAM DISPENSER

(75) Inventor: Edgar Ivo Maria van der Heijden, Broek Op Langedijk (NL)

(73) Assignee: Rexam Airspray N.V., Alkmaar (NL)

( * ) Notice: Subject to any disclaimer, the term of this patent is extended or adjusted under 35 U.S.C. 154(b) by 507 days.

(21) Appl. No.: 12/307,693

(22) PCT Filed: Jul. 11, 2006

(86) PCT No.: PCT/NL2006/000351

§ 371 (c)(1),
(2), (4) Date: Jan. 6, 2009

(87) PCT Pub. No.: WO2008/007943

PCT Pub. Date: Jan. 17, 2008

(65) Prior Publication Data

US 2009/0236371 A1 Sep. 24, 2009

(51) Int. Cl.
*B67D 7/78* (2010.01)
*B67D 7/76* (2010.01)

(52) U.S. Cl. ..... 222/145.3; 222/190

(58) Field of Classification Search ..... 222/190, 222/192, 145.3, 145.5, 135, 321.7, 321.8, 222/321.9, 189.01
See application file for complete search history.

(56) References Cited

U.S. PATENT DOCUMENTS

| | | | | |
|---|---|---|---|---|
| 2,914,220 | A * | 11/1959 | Marraffino | 222/145.3 |
| 2,925,938 | A * | 2/1960 | Parsons | 222/94 |
| 2,944,704 | A * | 7/1960 | Taylor, Jr. | 222/94 |
| 3,042,263 | A | 7/1962 | Gallo, Sr. | |
| 3,135,428 | A * | 6/1964 | Gallo | 222/94 |
| 3,311,263 | A | 3/1967 | Harmon | |
| 4,022,351 | A | 5/1977 | Wright | |
| 5,007,563 | A | 4/1991 | de Laforcade | |
| 5,289,952 | A | 3/1994 | Gueret | |
| 6,024,012 | A | 2/2000 | Luzenberg, Jr. | |
| 6,536,629 | B2 * | 3/2003 | van der Heijden | 222/190 |
| 6,612,468 | B2 * | 9/2003 | Pritchett et al. | 222/190 |
| 6,675,812 | B1 | 1/2004 | Wiley | |
| 7,726,518 | B2 * | 6/2010 | Brouwer | 222/145.6 |
| 7,802,701 | B2 * | 9/2010 | Jahan et al. | 222/153.13 |
| 7,850,048 | B2 * | 12/2010 | Arminak | 222/190 |
| 2002/0056730 | A1 * | 5/2002 | van de Heijden | 222/190 |
| 2004/0149777 | A1 * | 8/2004 | Santagiuliana | 222/190 |
| 2007/0215642 | A1 * | 9/2007 | van der Heijden | 222/190 |
| 2009/0020552 | A1 * | 1/2009 | van der Heijden | 222/1 |
| 2009/0206109 | A1 * | 8/2009 | Santagiuliana | 222/190 |

FOREIGN PATENT DOCUMENTS

| | | |
|---|---|---|
| CN | 2201172 Y | 6/1995 |
| DE | 0 368 724 A1 | 10/1989 |
| EP | 1 412 282 | 5/1990 |
| EP | 0 613 728 B1 | 8/1997 |

(Continued)

*Primary Examiner* — Kevin P Shaver
*Assistant Examiner* — Stephanie E Williams
(74) *Attorney, Agent, or Firm* — Hoffmann & Baron, LLP

(57) ABSTRACT

A foam dispenser having a pump assembly includes a liquid pump, an air pump and a common actuation part to simultaneously actuate the liquid pump and the air pump. The pump assembly includes a dispensing channel having a dispensing opening. The pump assembly further includes a porous matrix which contains a dispensate material. A contact surface of the porous matrix is arranged in communication with the dispensing channel, so that foam being formed in the pump assembly and dispensed through the dispensing channel comes into contact with the contact surface to introduce dispensate material released from the porous matrix in the foam.

13 Claims, 3 Drawing Sheets

FOREIGN PATENT DOCUMENTS

| | | | |
|---|---|---|---|
| JP | 6-211261 | A | 8/1994 |
| JP | 10-29652 | A | 2/1998 |
| TW | 586369 | | 5/2004 |
| WO | 2005/102539 | A1 | 11/2005 |

* cited by examiner

FOAM DISPENSER

CROSS-REFERENCE TO RELATED APPLICATIONS

This application is the National Stage of International Application No. PCT/NL2006/000351, filed Jul. 11, 2006, the contents of which is incorporated by reference herein.

FIELD OF THE INVENTION

The present invention relates to a foam dispenser for dispensing a liquid in the form of a foam. More particularly, the present invention relates to a foam dispenser with which a foam flow can be dispensed which comprises a stripe which may have another color than the main foam flow.

BACKGROUND OF THE INVENTION

Manual foam dispenser are well known in the art and for instance disclosed in EP 0613728 B1. These foam dispensers comprise a pump assembly which can be mounted on or in an opening of a reservoir for holding a liquid to be dispensed in the form of a foam. The pump assembly comprises a liquid pump for pumping the liquid from the reservoir and an air pump to mix air with the liquid in order to form a foam. The foam is dispensed through a dispensing channel out of a dispensing opening. In the dispensing channel one or more porous elements such as sieves may be arranged to form a homogeneous foam.

In some applications it is desirable to provide in the main foam flow formed by the foam dispenser a stripe having a different color or having other distinct characteristics, such as taste or scent.

In order to obtain such stripe in the foam flow, it is known to provide a dispensing unit having two pump assemblies being connected to each other. Each of the pump assemblies is designed to dispense upon simultaneous actuation of said pump assemblies a foam flow. The foam flows are in a possible embodiment dispensed on top of each other. As the foam flows are formed by liquid out of different reservoirs, the resulting foam flows may for instance have different colors.

This known dispensing unit is for instance disclosed in WO 2005/102539. With this known dispensing unit a main foam flow having a stripe of different color can be provided, the stripe being formed by a second foam flow which is dispensed by a second pump assembly. The second flow forming the stripe at the top of the main flow may also be a liquid flow.

A drawback of this known foam dispenser is that a separate pump assembly has to be provided to form a second liquid or foam flow which is used to provide a stripe in the main foam flow. This makes the foam dispenser technically complex and more expensive.

OBJECT OF THE INVENTION

It is an object of the invention to provide a foam dispenser with which a stripe can be formed in the main foam flow, which stripe may have another color or other characteristics than the main foam flow.

SUMMARY OF THE INVENTION

According to an embodiment of the invention a foam dispenser is provided comprising a pump assembly to be mounted on or in an opening of reservoir for holding a liquid to be dispensed in the form of a foam, said pump assembly comprising a liquid pump for pumping liquid from said reservoir, an air pump for pumping air and a common actuation part to simultaneously actuate said liquid pump and said air pump, wherein said pump assembly comprises a dispensing channel having a dispensing opening, wherein liquid and air being pumped upon actuation of said common actuation part are mixed to form a foam which is dispensed through said dispensing opening, wherein the pump assembly further comprises a porous matrix which contains a dispensate material, a contact surface of said porous matrix being arranged in communication with said dispensing channel, so that foam being formed in said pump assembly and dispensed through said dispensing channel comes into contact with said contact surface to introduce dispensate material released from said porous matrix in said foam.

It is remarked that an article or object having a porous matrix containing a dispensate material as such is known. For instance U.S. Pat. No. 6,024,012, the contents of which is hereby incorporated by reference, discloses the use of such article to provide a dispensate material in a beverage. The porous matrix disclosed in the U.S. '012 patent contains a dispensate material, such as flavoring materials, coloring materials, medications, minerals and caffeine. This dispensate material is released in a liquid of a beverage when this liquid comes into contact with a contact surface of said matrix. The dispensate material is completely mixed within the beverage liquid, so that the whole beverage has the same taste, color and composition.

The present invention comprises the use of porous matrix containing a dispensate material in a foam dispenser. Different than in the applications described in U.S. Pat. No. 6,024,012, the provision of a porous matrix containing a dispensate material can be used in a foam dispenser to form a stripe in the main foam flow having a different color than the main foam flow.

Thus, there is no longer the need to provide a separate pump for pumping a colorant liquid in order to form such stripe. In other embodiments the dispensate material may contain flavoring materials or scent materials to give the foam flow a desired taste or scent. This may also be done in combination with each other or in combination with a coloring material. Any other dispensate material having certain desirable characteristics may also be used as dispensate material in the present invention.

In an embodiment the contact surface of the porous matrix is arranged at a top or sides of the dispensing channel. After that an amount of foam has been dispensed with the foam dispenser the dispensing channel will be filled with foam. This foam will after a certain time return to a fluid state and therewith the volume of the foam material will substantially decrease. By placing the porous matrix at the top or side of the dispensing channel, the contact surface will no longer be in contact with the foam or liquid as soon as the foam is at least partially returned to the liquid state, and the dispensate material will no longer be released from the porous matrix to the liquid remaining in the dispensing channel. Thus even when the foam dispenser is not used for a certain time there will still be enough dispensate material to provide a stripe on foam being dispensed from the foam dispenser. Furthermore, it is prevented that a relatively large amount of dispensate material is released in the foam/liquid residing in the dispensing channel. This foam when dispensed during renewed actuation of the foam dispenser would have a stripe which is too wide or has a too dark color, or in the case of flavoring or scenting dispensate materials, a too strong taste or smell.

Therefore, the contact surface or contact surfaces is/are preferably placed in an upper region of the dispensing channel. It is remarked that this position of the contact surface with respect to the dispensing channel is to be determined in the normal "at rest" position of the foam dispenser.

In contrast to the above it is remarked that, in the case of a liquid dispenser, the liquid which will be present in the dispensing channel after dispensing, will keep occupying the whole dispensing channel since no volume change in the liquid will occur. As a consequence, dispensate material may continuously be released in the liquid being in contact with the contact surface of the porous matrix. As a possible result, all dispensate material will be used before the liquid in the liquid reservoir is depleted, and therefore not all liquid dispensed by the liquid dispenser would have the desired effect of dispensate material in the dispensed liquid. When in a foam dispenser the contact surface of the porous matrix is not placed at the bottom of the dispensing channel, this risk on early depletion of the dispensate material is substantially reduced.

In an embodiment, the ratio between the contact surface and the volume of the porous matrix is chosen such that the amount of dispensate material is gradually introduced in the foam being dispensed. It may be desirable to gradually release the amount of dispensate material in the porous matrix, into the foam flow passing the contact surface, so that the whole liquid contents of the reservoir may be dispensed, the foam flow having a stripe with the desired characteristics. The amount of dispensate material which is released may for instance also be important for the width of the stripe and/or the intensity of the color, taste or scent provided by the dispensate materials in the foam flow.

In an embodiment the porous matrix may have has a rectangular shape having a side directed to the dispensing channel, wherein said contact surface is maximally 50% of the surface area of said side. By using only a part of the side directed to the dispensing channel as a contact surface to introduce dispensate material in the foam flow, and covering the rest of said side, a gradual introduction of the dispensate material in the foam flow may be obtained. The covering of a part of the side may for instance be obtained by providing a wall between that part of the side of the article and the dispensing channel, or by closing or not providing the pores in the surface area of that part of the side of the porous matrix.

In a preferred embodiment, the matrix defines an internal network of passages and defines pores on a exposed surface of the matrix in fluid communication with the passages, the dispensate material residing within the passages. The pores have an average size of from about 20 microns to about 200 microns. The porous matrix may be made of a plastic material such as a thermoplastic polymer (for instance polyethylene or polypropylene).

The dispensate material may be in the form of a powder, a liquid or any other suitable form. The dispensate material is preferably soluble or dispersible in the foam.

SHORT DESCRIPTION OF THE DRAWINGS

Further advantages and characteristics of embodiments of the invention will now be explained at the hand of the description of a preferred embodiment of the present invention, in which description reference will be made to the following drawings.

DETAILED DESCRIPTION OF PREFERRED EMBODIMENT

Figure 1:
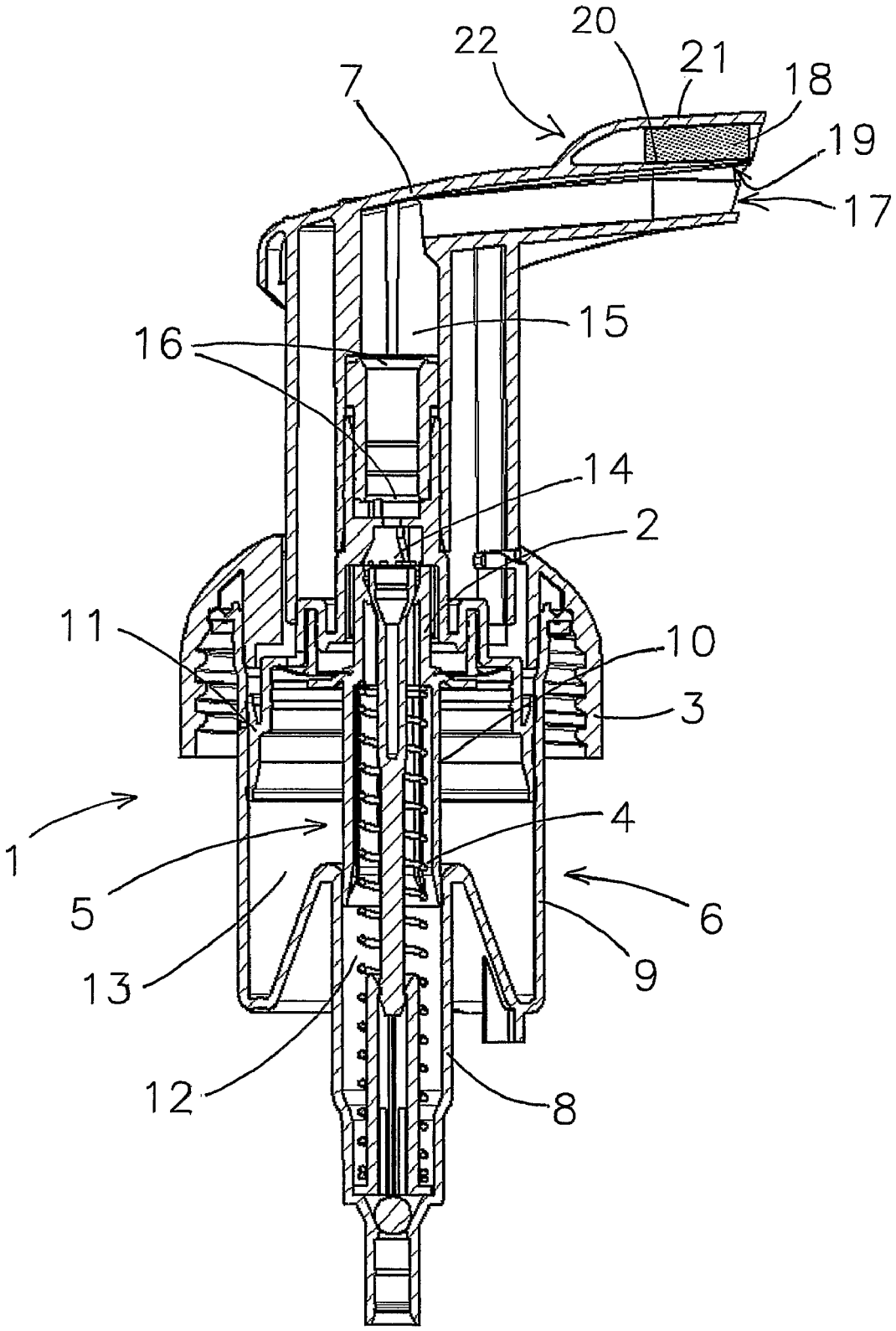
FIG. 1 shows an embodiment of a foam dispenser according to the invention.

FIG. 1 shows a foam dispenser for dispensing a foam, which foam dispenser is indicated by reference numeral 1. The foam dispenser 1 comprises a pump assembly 2 which is fixed by means of a fixing collar 3 on a reservoir (not shown) in which the liquid to be dispensed is stored. The pump assembly 2 comprises a liquid pump 5, an air pump 6 and a common actuation part 7. The liquid pump 5 and the air pump 6 are piston pumps. The pump housing of both the liquid pump 5 and the air pump 6 is formed by a double cylinder, comprising liquid pump cylinder 8 and air pump cylinder 9. In the liquid pump cylinder 8 a liquid piston 10 and in the air pump cylinder 9 an air piston 11 is fitted, respectively.

The liquid pump cylinder 8 and the liquid piston 10 delimit a liquid pump chamber 12. The air pump cylinder 9 and the air piston 11 delimit an air pump chamber 13.

The basic principle of operation of the foam dispenser 1 will now be explained. Upon actuation of the common actuation part 7, i.e. when the common control part 7 is pushed downwards, the liquid piston 10 and the air piston 11 will move downwards therewith compressing the liquid and air in the liquid pump chamber 12 and air pump chamber 13, respectively.

The liquid and air will both be pumped into a mixing chamber 14 where the air and liquid are mixed. This mixing chamber 14 is part of a dispensing channel 15 which extends through the common actuation part 7. The liquid-air mixture which is obtained in the mixing chamber 14 will subsequently be guided through two sieve-like elements 16, so that a firm and homogenous foam is formed. This foam is guided further through the dispensing channel 15 to a dispensing opening 17, where the foam is dispensed.

When the common actuation part 7 is released, a spring 4 will push the common actuation part 7 back upwards to the initial position. During this upward stroke the liquid pump chamber 12 and the air pump chamber 13 will increase in size since the liquid piston and air piston will also move upwards with respect to the double cylinder. As a result liquid will be drawn from the reservoir 4 into the liquid pump chamber 12 and air will be sucked into the air pump chamber 13. When the common actuation part 7 has returned to its initial position it can be pushed downwards again in order to dispense a new amount of foam from the dispensing opening.

Further details on the possible embodiments of a manual foam dispenser and the operation thereof, with exception of the features of the present invention, are for example disclosed in European Patent EP 0613728 B1, the contents of which is included herein by reference.

Foam dispensers of the above described type are used for dispensing a foam which for example can be used as soap, shampoo, shaving foam, candy, dishwasher detergent for manual dishwashing, other detergents such as for washing, sun cream, tooth paste and such.

According to the present invention the pump assembly 2 comprises a porous matrix 18 which contains a certain amount of dispensate material. Such porous matrix 18 may be made of a plastic material, and define an internal network of passages as well as pores on a exposed surface of the matrix in fluid communication with the passages. The dispensate material resides within the passages. The pores may for instance have an average size of from about 20 microns to about 200 microns. The plastic material of the porous matrix 18 may for instance be a thermoplastic polymer, such as polyethylene or polypropylene. An example of such porous matrix may for instance be found in U.S. Pat. No. 6,024,012, the contents of which are hereby introduced be reference.

The dispensate material may be in the form of a powder or a liquid or any other suitable form. The dispensate material is preferably soluble or dispersible in the foam. The dispensate material may for instance be a coloring material, a flavoring material, a scenting material, a combination of these materials, or any other desirable material.

The porous matrix 18 comprises a contact surface 19 which is in communication with the dispensing channel 15, so that dispensate material which is contained in said porous matrix 18 may be released from said porous matrix 18 and introduced into a foam flow which upon actuation of the common control part 7 comes into contact with the contact surface 19 of the porous matrix 18. As the contact surface 19, which is located at the top of the dispensing channel 15, will only come into contact with the top surface of the foam flow, the foam flow dispensed from the dispensing opening 17 will have a stripe at the top side which contains the dispensate material. When the dispensate material is a colorant this stripe will be clearly visible for the user and give the foam flow an attractive appearance.

It is also possible to provide a stripe of scenting material or a stripe of flavoring material. In a particular embodiment, a combination of different types of dispensate materials can be used, for instance a color and scent material.

Figure 2:
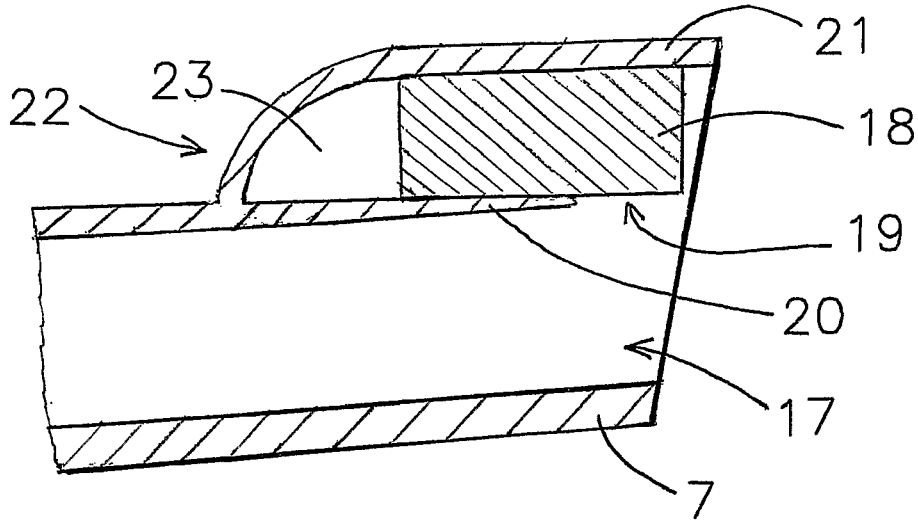
FIG. 2 shows a detail of the foam dispenser of FIG. 1.

FIG. 2 shows the position of the porous matrix 18 with respect to the dispensing channel 15 in more detail. The porous matrix 18 is held between a first wall 20 and a second wall 21. The first wall 20 which extends between the dispensing channel 15 and the space 23 in which the porous matrix 18 is held, only covers a part of the side of the porous matrix 18 which is directed towards the dispensing channel so that a part of this side which is in communication with said dispensing channel forms the contact surface 19 through which the dispensate material can be released in a foam flow being dispensed.

The ratio between said contact surface 19 of said porous matrix 18 and the volume of dispensate material in said porous matrix 18 is chosen such that the amount of dispensate material is gradually released in the foam that comes into contact with the contact surface 19. In this way a relative large amount of foam can be dispensed without the dispensate material being depleted.

In the shown embodiment, the porous matrix 18 has a rectangular shape having a large side directed to the dispensing channel, wherein said contact surface is maximally 50% of the surface area of said side. In this way the contact surface 19 is relatively small compared with the volume of the porous matrix 18. But at the same time the height of the porous matrix 18 is relatively small so that the extra height of the common actuation part 7 is low.

In an embodiment the porous matrix 18 may have a height of approximately 3 mm, a length of approximately 10 mm, and a width of of approximately 3.5 mm. The contact surface is approximately 3 mm×3.5 mm.

In an alternative embodiment the porous matrix 18 may be provided at another location with respect to said dispensing channel 15, for instance at a side of the dispensing channel 18. It will be clear that in such embodiment the stripe will appear at another location of the foam flow, in particular at the side of the foam flow.

In the embodiment shown in FIGS. 1 and 2, the contact surface 19 is located at (or close to) the dispensing opening 17. Consequently, the foam flow will be dispensed out of the dispensing opening 17 shortly after that the dispensate material is introduced in the foam flow. Therefore, the dispensate material will have little time to mix within the foam, resulting in a relatively thin and sharply outlined stripe in the foam flow. When the distance between the location of the contact surface 19 and the dispensing opening 17 would be longer, the resulting stripe may, also depending on the dispensate material and the foam, be wider and less well defined. Dependent on the desired effect, this distance may be chosen.

In the shown embodiment, the porous matrix 18 is firmly attached in the common actuation part 7 of the foam dispenser 1, for example glued in the space 23. In an alternative embodiment the porous matrix 18 may be provided in an exchangeable porous matrix member 22. This exchangeable porous matrix member 22 may be selected depending on the type of stripe which is desired to appear in the foam flow. For example, the manufacturer or user of a soap foam dispenser may be given the choice between a porous matrix member 22 which provides a green color and an apple scent or another porous matrix member 22 which provides a yellow color and a lemon scent. Such embodiments provides flexibility for the manufacturer and/or freedom of choice for the user.

In this respect it may also be possible that the porous matrix member 22 is exchanged for a corresponding porous matrix member 22 which contains the same dispensate material, for example when the dispensate material in the first porous matrix is depleted.

Figure 3:
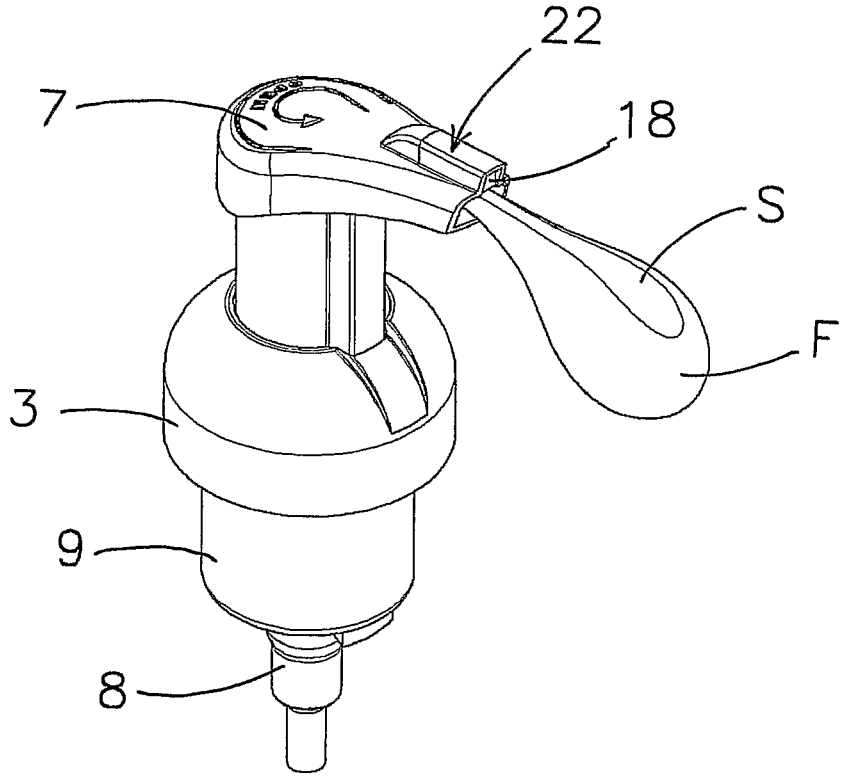
FIG. 3 shows a perspective view of the foam dispenser of FIG. 1.

FIG. 3 shows a perspective view of a foam dispenser 1 according to the invention, just after actuation of the common actuation part 7. A foam flow being dispensed from the dispensing opening is shown. Such foam flow F will normally be dispensed on a surface, such as the palm of the hand. It is clearly visible that the foam flow F comprises a stripe S at the top side which is the result of the release of dispensate material from the porous matrix 18 when the foam flow comes into contact with the contact surface 19 of the porous matrix 18 in the dispensing channel 15. The resulting foam flow F with the stripe S has an attractive appearance and may have other characteristics such as a certain flavor or scent as a result of the dispensate material released from the porous matrix into the foam flow.

In the above-described embodiment, only one contact surface in communication with the dispensing channel is provided. In alternative embodiments, it also possible to provide two or more contact surfaces 19 along the circumference of the dispensing channel, so that a corresponding number of stripes may be provided on a foam flow which is dispensed from the foam dispenser. In such embodiment having more than one contact surfaces 19, one porous matrix per contact surface may be provided. However, it is also possible that one porous matrix 18 comprises two or more contact surfaces 19, whereby the dispensate material can be released in the foam flow via the contact surfaces 19.

Figure 4:
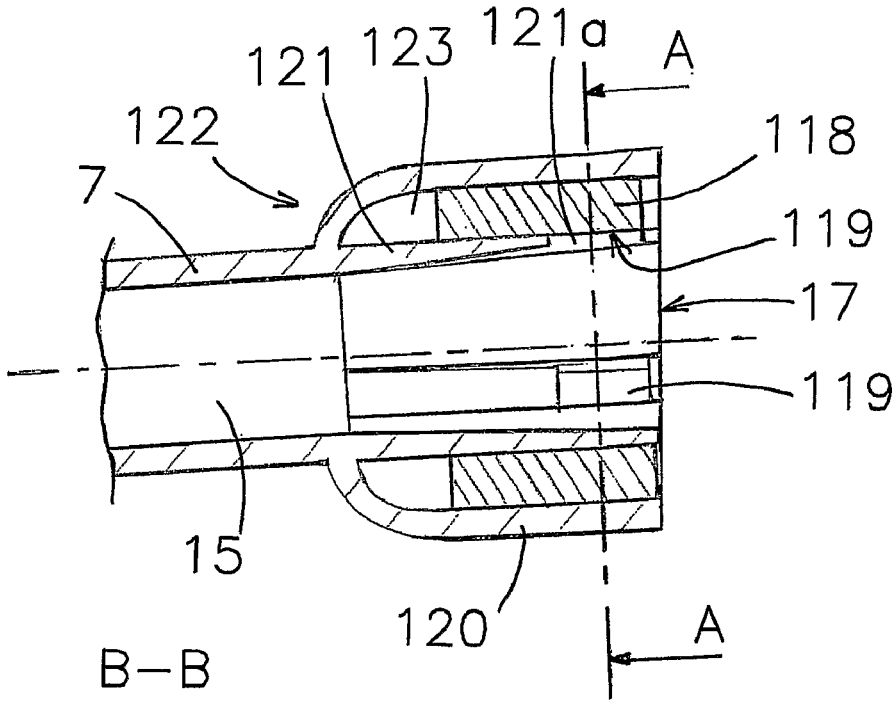
FIG. 4 shows a cross section of an alternative embodiment of a porous matrix extending around a dispensing channel of a foam dispenser.
Figure 5:
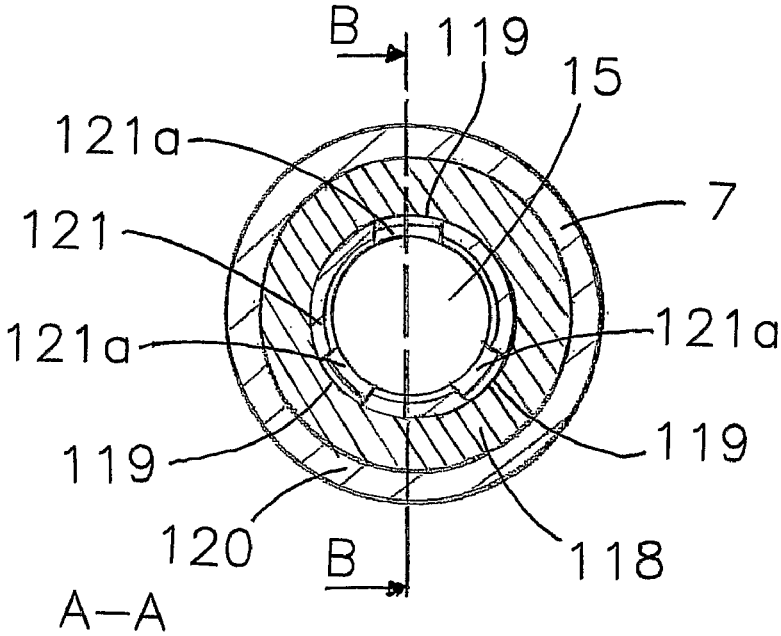
FIG. 5 shows another cross-section of the embodiment of FIG. 4.

FIGS. 4 and 5 show in cross section an alternative embodiment of a porous matrix 118 having three contact surfaces 119.

In the embodiment of FIGS. 4 and 5, the porous matrix 118 is ring-shaped and extends around the dispensing channel 15, the three contact surfaces 119 being in communication with the dispensing channel 15.

One of the contact surfaces 119 is placed at the top of the dispensing channel 15, while the other two are placed at the respective sides of the dispensing channel 15. The contact surfaces 119 are arranged at equal angles around the dispensing channel. However, any other desirable arrangement, having two or more contact surfaces 19 may also be applied.

The ring-shaped porous matrix 118 is fixed in a ring-shaped space 123 which extends around the dispensing channel 15. The ring-shaped space 123 is separated from the dispensing channel 15 by means of a wall 121 which comprises apertures 121*a* which expose the contact surfaces 119 to the dispensing channel 15. At the outer circumference the space 123 is delimited by the wall 120.

Instead of the ring-shaped porous matrix 118 it is possible to provide a separate porous matrix, for each of the contact surfaces 19. For instance, at each of the locations of the three contact surfaces 119, a porous matrix element 22 according to the embodiment of FIGS. 1-3 may be provided to obtain a foam dispenser which upon actuation dispenses a foam flow having three stripes.

Furthermore, the ring-shaped porous matrix 118 may, in an alternative embodiment, be comprised in an exchangeable porous matrix element 122, which may be exchanged when desired for another porous matrix element 122 containing the same or another dispensate material. In this context exchangeable may also mean being usable as one of several alternatives, for instance when for the first and possible only time a porous matrix element 122 is fixed on a foam dispenser.

The invention claimed is:

1. A foam dispenser comprising a pump assembly to be mounted on or in an opening of a reservoir for holding a liquid to be dispensed in the form of a foam, said pump assembly comprising a liquid pump for pumping liquid from said reservoir, an air pump for pumping air and a common actuation part to simultaneously actuate said liquid pump and said air pump, wherein said pump assembly comprises a dispensing channel having a dispensing opening, wherein liquid and air being pumped upon actuation of said common actuation part are mixed to form a foam which is dispensed through said dispensing channel, wherein the pump assembly further comprises a porous matrix which contains a dispensate material, a contact surface of said porous matrix being arranged in communication with said dispensing channel, so that foam being formed in said pump assembly and dispensed through said dispensing channel comes into contact with said contact surface to introduce dispensate material released from said porous matrix in said foam;

wherein the dispensing channel comprises a substantially vertical part and a substantially horizontal part, wherein one end of the substantially horizontal part is connected to a top end of the substantially vertical part and the dispensing opening is arranged at an opposed end of the mainly horizontal part; and wherein said contact surface of said porous matrix is only arranged at a top of the substantially horizontal part of said dispensing channel, so that the contact surface will no longer be in contact with the foam or liquid when the foam present in the dispensing channel after dispensing an amount of foam returns to the liquid state in a period wherein no foam is dispensed from the foam dispenser.

2. The foam dispenser of claim 1, wherein the ratio between said contact surface of said porous matrix and the volume of dispensate material in said porous matrix is chosen such that the amount of dispensate material is gradually introduced in the foam being dispensed.

3. The foam dispenser of claim 1, wherein said porous matrix has a rectangular shape having a side directed to the dispensing channel, wherein said contact surface is maximally 50% of the surface area of said side.

4. The foam dispenser of claim 1, wherein said dispensing channel extends through said common actuation part, and wherein said porous matrix is arranged at a side of said dispensing channel.

5. The foam dispenser of claim 1, wherein said porous matrix is arranged in said dispensing channel at a location close to or at said dispensing opening.

6. The foam dispenser of claim 1, wherein said matrix defines an internal network of passages and defines pores on an exposed surface of the matrix in fluid communication with the passages, the dispensate material residing within the passages.

7. The foam dispenser of claim 6, wherein said pores have an average size of from about 20 microns to about 200 microns.

8. The foam dispenser of claim 1, wherein a wall is provided between said matrix and said dispensing channel so that only a part of a side of said matrix being directed to said dispensing channel forms said contact surface.

9. The foam dispenser of claim 1, wherein said dispensate material comprises one or a combination selected from the group consisting of colorants, flavoring materials, and scenting materials.

10. The foam dispenser of claim 1, wherein said porous matrix is comprised in a porous matrix member which is detachably attached to the pump assembly.

11. The foam dispenser of claim 1, wherein said porous matrix member is exchangeable for another porous matrix member having a porous matrix containing a dispensate material having the same or different characteristics.

12. The foam dispenser of claim 1, wherein said foam dispenser comprises a liquid reservoir for holding a liquid to be dispensed in the form of a foam, said pump assembly mounted in or on an opening of said liquid reservoir.

13. The use of a porous matrix containing a dispensate material in a foam dispenser in order to provide a stripe of said dispensate material in a foam flow being dispensed upon actuation of said foam dispenser, wherein a contact surface of said porous matrix in arranged in communication with a dispensing channel of the foam dispenser, so that foam being formed in a pump assembly of the foam dispenser and dispensed through said dispensing channel comes into contact with said contact surface to introduce dispensate material released from said porous matrix in said foam, wherein the dispensing channel comprises a substantially vertical part and a substantially horizontal part, wherein one end of the substantially horizontal part is connected to a top end of the substantially vertical part and the dispensing opening is arranged at an opposed end of the mainly horizontal part, wherein said contact surface of said porous matrix is only arranged at a top of the substantially horizontal part of said dispensing channel, so that the contact surface will no longer be in contact with the foam or liquid when the foam present in the dispensing channel after dispensing an amount of foam returns to the liquid state in a period wherein no foam is dispensed from the foam dispenser.

* * * * *